United States Patent [19]

Priest

[11] 4,323,742

[45] Apr. 6, 1982

[54] HIGH PRESSURE DIFFERENTIAL SWITCH DEVICE

[75] Inventor: Wayne A. Priest, Kansas City, Kans.

[73] Assignee: SOR, Inc., Olathe, Kans.

[21] Appl. No.: 109,451

[22] Filed: Jan. 4, 1980

[51] Int. Cl.[3] ..... H01H 35/38

[52] U.S. Cl. ..... 200/82 C; 200/83 S

[58] Field of Search ..... 200/81 R, 81.4, 81.5, 200/83 S, 83 J, 302, 82 R, 82 C

[56] References Cited

U.S. PATENT DOCUMENTS

| | | | |
|---|---|---|---|
| 510,921 | 12/1893 | Merritt | 200/82 R |
| 697,273 | 4/1902 | Plumtree | 200/82 R |
| 2,096,492 | 10/1937 | Hewitt | 200/82 R |
| 2,244,402 | 6/1941 | Powers | 200/82 C |
| 2,749,536 | 6/1956 | Sperling | 340/242 |
| 2,803,718 | 8/1957 | Bloom | 200/82 C |
| 2,895,024 | 7/1959 | Brown | 200/82 C |
| 2,982,830 | 5/1961 | Schaefer | 200/83 S |
| 3,930,134 | 12/1975 | Rostron | 200/83 A |
| 4,004,839 | 1/1977 | Burgdorf | 200/82 D |
| 4,182,941 | 1/1980 | Tashiro | 200/83 S |

*Primary Examiner*—Gerald P. Tolin

*Attorney, Agent, or Firm*—Lowe, Kokjer, Kircher, Wharton & Bowman

[57] ABSTRACT

A switch which is actuated when a preselected fluid pressure differential is exceeded. A piston exposed to the pressure differential carries a plunger which contacts a lever arm mounted on a shaft. A spring normally prevents the shaft from turning but is overcome when an excessive pressure differential is applied across the piston. A switch arm mounted on the shaft actuates the switch in response to turning of the shaft.

12 Claims, 6 Drawing Figures

2.
3.
4.
10
12
14
16
20
22
24
26
34
36
46
48
92
110

110
20
22
104
112
102
100
96
98
106
108
73
72
60
16

92
88
94
86
90
84
34
86a
14
24
82
36
26
60
78
73
80
76
74
72
16

HIGH PRESSURE DIFFERENTIAL SWITCH DEVICE

BACKGROUND AND SUMMARY OF THE INVENTION

This invention relates generally to pressure responsive switches and deals more particularly with a switch device which is sensitive to a pressure differential between low and high sides of a fluid system.

Various types of fluid systems are equipped with switches that are actuated when there is an excessive pressure differential between two parts of the system. Although existing switches of this type have functioned well for the most part, they have not been wholly without problems. The useful life of some existing pressure differential switches is relatively short, particularly for switches used in high pressure service and those subjected to transient shock or spike loads. Some devices must be connected in one particular orientation to the high and low pressures and can be severely damaged if connected in a reverse fashion. When the pressures to which the switch is exposed vary over a wide range, it is difficult to accurately maintain the differential set point, and the sensitivity of the device suffers accordingly. Another serious problem has been to prevent deterioration of the components of the switch when corrosive fluids are being handled.

Existing switch devices are usually arranged such that the pressure sensitive components travel a relatively long distance in order to assure proper actuation of the switch when the set differential pressure is exceeded. This long travel increases the wear on the various parts, particularly where seal elements and/or linkages are employed. Additionally, in some cases it is difficult if not impossible to vary the set point of existing devices while they are in service under pressure.

The present invention is directed to an improved pressure differential switch and has, as its primary object, the provision of a switch device which is capable of functioning effectively over a wide range of pressures and a wide range of pressure differentials. The device is constructed to withstand pressures up to approximately 3,000 psi with either port connected with the high pressure side of the system. The unit is also constructed in modular fashion so that the components can be changed to permit a wide variation in the differential set point and to accomodate pressures up to 10,000 psi.

Another important object of the invention is to provide a switch device of the character described which can readily absorb severe transient shock loads without damage.

Yet another important object of the invention is to provide a switch device of the character described in which the travel of the pressure responsive components is limited without adversely affecting proper actuation of the switch.

A further object of the invention is to provide a switch device of the character described wherein the pressurized fluid medium is isolated from the critical components of the unit so that corrosive fluids can be readily handled.

A still further object of the invention is to provide a switch device of the character described which may be quickly and easily assembled and disassembled and which presents no danger from excessive pressure buildup.

Other and further objects of the invention, together with the features of novelty appurtenant thereto, will appear in the course of the following description.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION OF THE INVENTION

Figure 4:
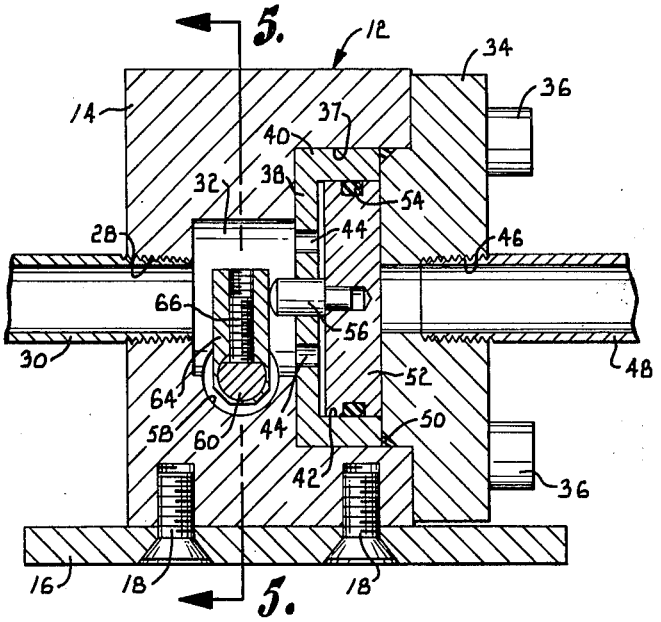
FIG. 4 is a sectional view taken generally along line 4—4 of FIG. 1 in the direction of the arrows.

Referring now to the drawings in detail, reference numeral 10 generally designates a high pressure differential switch constructed in accordance with the present invention. Switch 10 has a housing 12 which includes a block or body 14 secured to a base plate 16 by a plurality of screws 18 (FIG. 4). A hollow switch housing 20 is secured to one side of body 14 by screws 22, while a hollow spring housing 24 is mounted to the opposite side of the body by screws 26. With particular reference to FIG. 4, body 14 is provided with a low pressure port 28 which is internally threaded in order to receive a low pressure conduit 30 which connects with the low pressure side of a fluid system. Port 28 communicates with a low pressure chamber 32 formed in body 14 internally of housing 12.

A cover plate 34 is screwed at 36 to the open side of body 14. Body 14 and cover plate 34 cooperate to present a space 37 adjacent to chamber 32 which receives a perforated disc 38. Integral with the periphery of disc 38 is a short cylinder 40 which presents therein a cylindrical piston chamber 42. Disc 38 has a plurality of openings 44 which provide fluid communication between low pressure chamber 32 and piston chamber 42. An internally threaded high pressure port 46 is formed in cover plate 34. Threaded into port 46 is a high pressure conduit 48 which leads to the high pressure side of the fluid system. Port 46 communicates with piston chamber 42 on the end opposite disc 38. A seal ring 50 provides a seal between body 14, plate 34, and cylinder 40.

A piston 52 is mounted closely in piston chamber 42 and is sealed to cylinder 40 by a seal ring 54 carried in an annular groove on the periphery of piston 52. A plunger 56 has a pin portion which is fitted in an opening formed in the face of piston 52 which is adjacent disc 38. Plunger 56 projects from piston 52 through a central opening in disc 38 and into the low pressure chamber 32. The end of plunger 56 remote from piston 52 has a rounded head portion.

Figure 5:
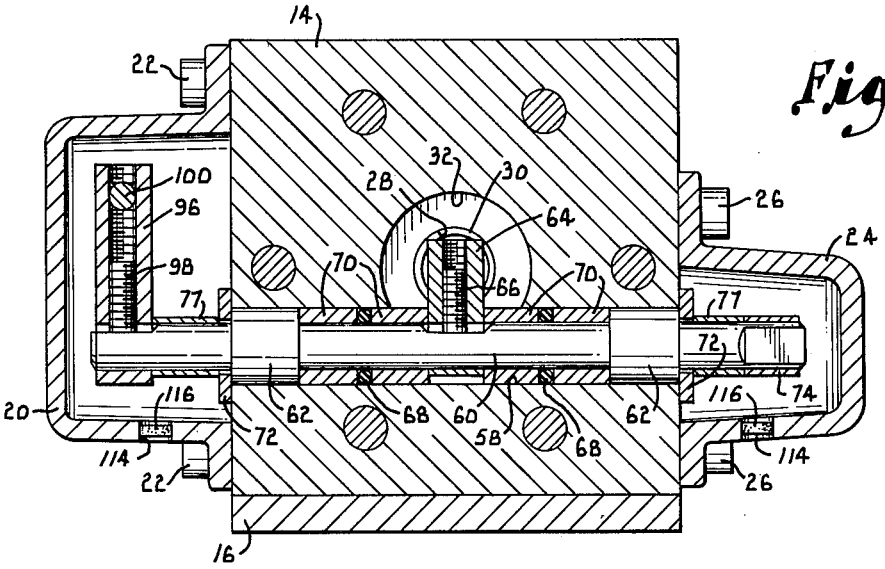
FIG. 5 is a sectional view taken generally along line 5—5 of FIG. 4 in the direction of the arrows.

Referring now particularly to FIG. 5, body 14 has a cylindrical horizontal bore 58 which extends between switch housing 20 and spring housing 24 and which intersects with the bottom portion of chamber 32. A shaft 60 extends through bore 58 and is supported for rotation by a pair of needle bearings 62 mounted in bore 58 at locations adjacent housings 20 and 24. A lever arm 64 is mounted on shaft 60 with an opening formed in the lever arm receiving the shaft. A set screw 66 is threaded into arm 64 and tightened against a flat surface of shaft 60 to mount the lever arm on the center of the shaft. On each side of the lever arm 64, an annular seal element 68 provides a seal between shaft 60 and body 14. Seal elements 68 are located between arm 64 and each bearing 62, and each seal element is mounted on shaft 60 between a pair of back-up rings 70 which are sleeved around shaft 60. Seal elements 68 permit shaft 60 to turn about its longitudinal axis while still providing effective seals which isolate the fluid pressure in chamber 32 from bearings 62 and the components located in housings 20 and 24. As shown in FIG. 4, the round head portion of plunger 56 contacts lever arm 64 at a location near the outer end of the lever arm. Bearings 62 are held in place between back-up rings 70 and bearing retainers 72 which are fitted against the sides of body 14 at locations within housings 20 and 24 and secured by screws 73.

Figure 3:
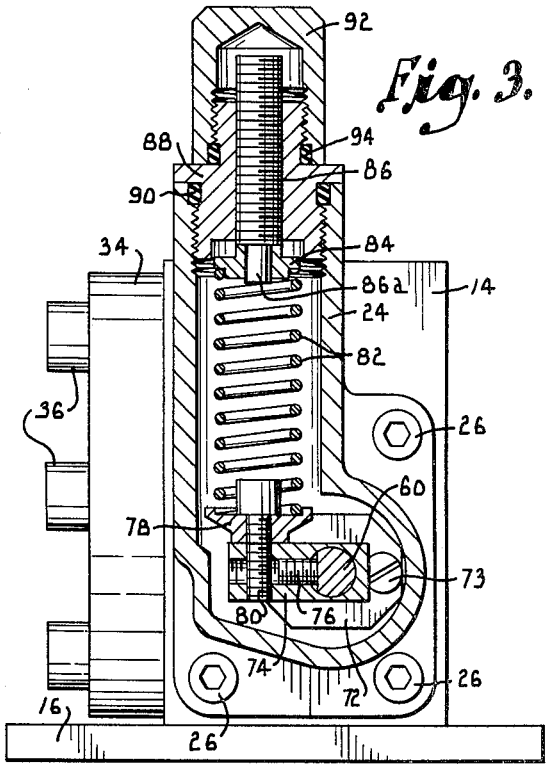
FIG. 3 is a sectional view taken generally along line 3—3 of FIG. 1 in the direction of the arrows.

With particular reference to FIG. 3, one end of the shaft 60 extends through an opening formed in a horizontal lever 74 which is located in spring chamber 24. A set screw 76 is threaded into lever 74 and tightened against shaft 60 in order to secure the lever on the shaft. A sleeve 77 (FIG. 5) serves as a spacer which extends from bearing retainer 72 to lever 74. A lower spring retainer 78 is mounted on the outer end of lever 74 by means of a screw 80 which is threaded into the lever and spring retainer. Retainer 78 receives the lower end of a compression spring 82 the upper end of which engages an upper spring retainer 84. The upper surface of retainer 84 abuts the lower end of a screw 86 having a projecting pin portion 86*a* fitting through retainer 84. Screw 86 is threaded through a fitting 88 which is in turn screwed to the top end of spring housing 24. A seal between fitting 88 and housing 24 is provided by an O-ring 90. Screw 86 is enclosed within a cap 92 which is threaded onto fitting 88 and sealed thereto by an O-ring 94.

Figure 1:
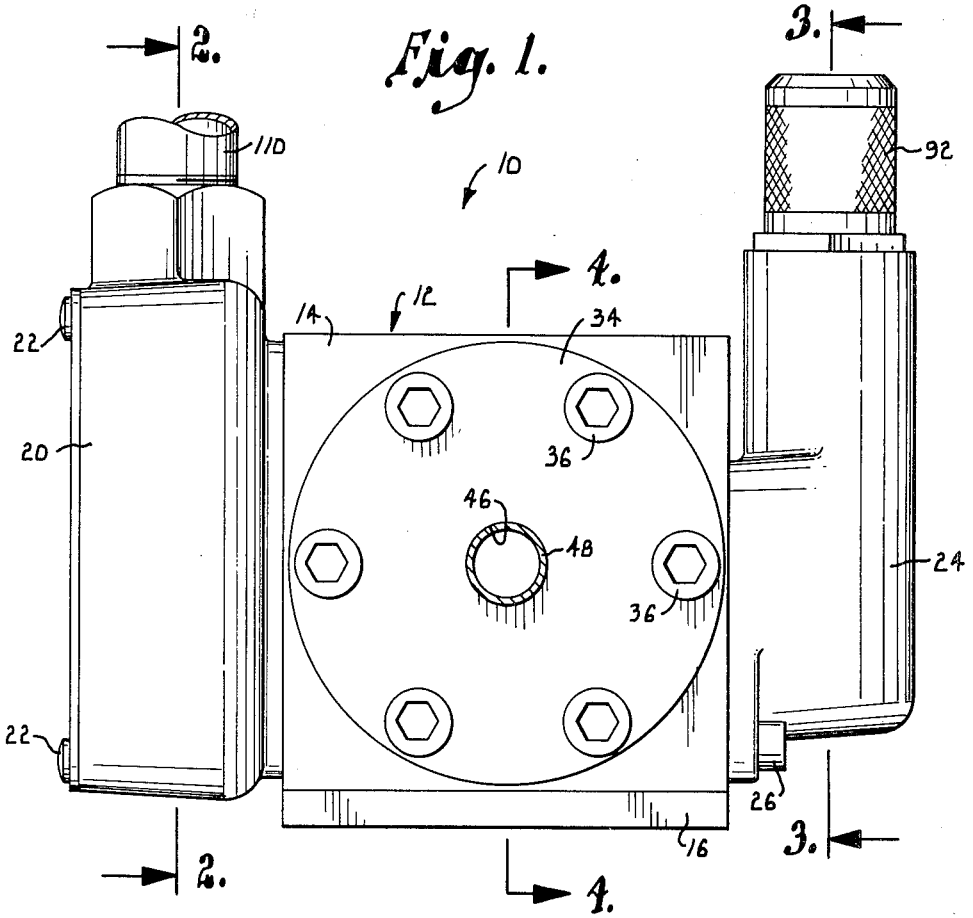
FIG. 1 is an elevational view of a pressure differential switch device constructed according to a preferred embodiment of the present invention.
Figure 2:
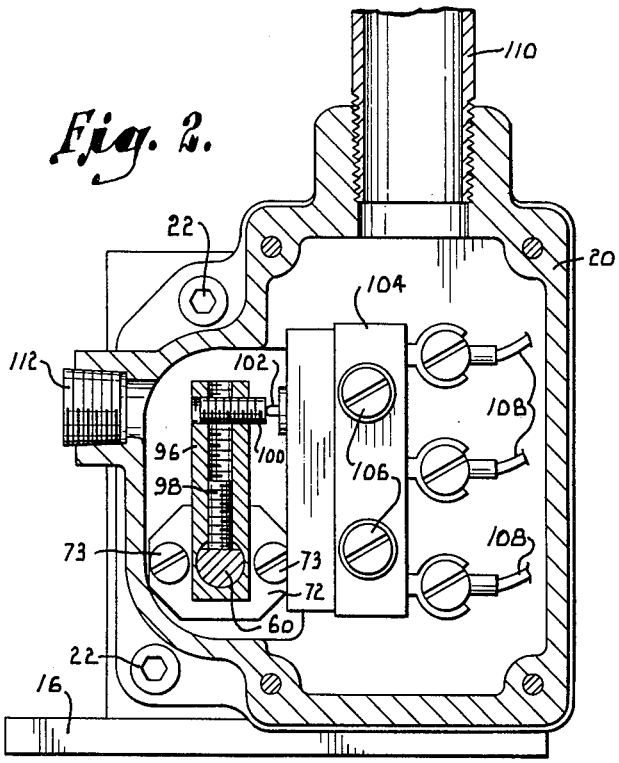
FIG. 2 is a sectional view taken generally along line 2—2 of FIG. 1 in the direction of the arrows.

As shown in FIGS. 2 and 5, switch housing 20 contains a vertical switch arm 96 which is mounted on the end of shaft 60 opposite lever 74. A set screw 98 is threaded into arm 96 and against shaft 60. The upper end of arm 96 carries a threaded pin 100 which projects beyond the side of the arm and has a flat end which contacts a plunger 102 of a switch 104. Switch 104 is secured within switch housing 20 by screws 106 and has conductor wires 108 which lead out of the switch housing through a conduit 110 threaded into the top of the switch housing. A threaded opening in one side of switch housing 20 is normally closed by a plug 112. Switch 104 is shown only as an example. It may, in fact, be a multiplicity of types of switches, (for example, a hermetically sealed switch) to accomodate various electrical loads and environmental conditions. Switch housing would change accordingly.

As shown in FIG. 5, switch housing 20 and spring housing 24 are each provided with a drain opening 114 in their bottom surfaces. Each drain port 114 is fitted with a porous disc 116 which permits venting of fluid pressure from within the switch housing and the spring housing.

In use, the biasing force exerted on arm 74 by spring 82 maintains shaft 60 in the rotative position shown in FIG. 4 so long as the pressure differential between the high and low sides of the fluid system, as sensed at ports 46 and 28, is below a preselected level which is determined by the setting of spring 82. In this position, the interaction between arm 64 and plunger 56 holds piston 52 against cover plate 34 since the pressure differential across the piston is insufficient to overcome the force of spring 82. However, the spring force is overcome if the pressure differential rises sufficiently. In this event, the force exerted on the right face of the piston through high pressure port 46 is greater than the spring force plus the force exerted on the left face of the piston through low pressure port 28, low pressure chamber 32, and openings 44. Piston 52 is then moved to the left until it bottoms against disc 38. The rounded head of plunger 56 pushes against lever arm 64 to rotate shaft 60 in a counter clockwise direction as viewed in FIG. 4.

Such rotation of shaft 60 carries switch arm 96 in a direction causing pin 100 to release plunger 102, thereby actuating switch 104. When actuated, switch 104 turns on or off appropriate equipment which counteracts or otherwise responds to the effects of the excessive pressure differential.

The pressure differential resulting in actuation of the switch can be adjusted by adjusting the force of spring 82. This can be accomplished by removing cap 92 and threading screw 86 into or out of fitting 88 to move upper spring retainer 84 toward or away from the lower spring retainer 78. Since the interior of spring housing 24 is completely isolated from the fluid pressure by seal ring 68, adjustment of the spring force can be undertaken while the unit is in service and exposed to high fluid pressure. It is also to be noted that seal rings 68 isolate bearings 62 and the components within switch housing 20 and spring housing 24 from the fluid medium and thus shield the critical components of the switch assembly from corrosive fluids and other damaging fluids employed in the fluid pressure system being monitored. In addition, abrupt transient shock loads or spike loads in the fluid system are not applied to the critical components of the switch assembly, due to the limited piston travel.

The travel of piston 52 is minimal, preferably approximately 10/1000 of an inch, although the travel can vary. Such small travel of the piston reduces the wear on it and seal ring 54, and also results in small rotational movement of shaft 60 in order to reduce the wear on the components associated with the shaft, especially seal elements 68. Preferably, the point of contact between plunger 56 and lever arm 64 is only about half as far from the center of shaft 60 as the point of contact between pin 100 and plunger 102 of switch 104. Consequently, a mechanical advantage is obtained whereby the movement of piston 52 is translated into twice as much movement of pin 100. Proper actuation of switch 104 is thus assured when the set pressure differential is exceeded. The small piston travel also results in a small volume displacement of fluid in piston chamber 42, a feature which is particularly important in low volume systems where a large fluid volume is not available.

It has been found that switch 10 is capable of maintaining an accurate differential set point with widely varying system pressures. For example, a 5 psi differential pressure has been maintained with system pressures which vary in the range of from 0 to approximately 3,000 psi. Seals 54 and 68 are able to withstand pressures up to 3,000 psi without appreciable leakage. In the event there is leakage past seal 68, drain ports 114 and discs 116 serve to vent the leaking fluid so that there is no danger of pressure build-up in the switch or spring housings.

Figure 6:
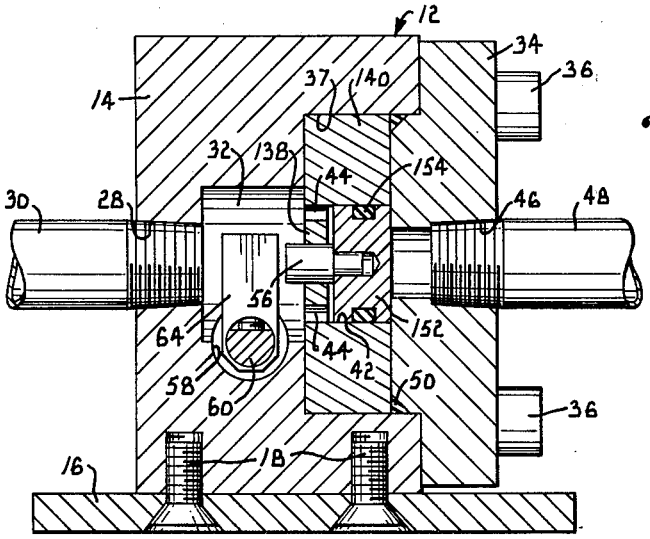
FIG. 6 is a sectional view similar to FIG. 4, but with a reduced size piston substituted for the larger piston shown in FIG. 4.

Switch 10 has a modular construction which permits any number of spring, piston, and shaft combinations to be employed. For example, FIG. 6 illustrates a relatively small piston 152 which replaces piston 52 and a relatively small perforated disc 138 having a thickened cylinder 140 which is sealed to piston 152 by an O-ring 154. Due to the reduced area of the faces of piston 152, a higher differential pressure range can be achieved with the same spring 82. Of course, pistons of various sizes can be used in combination with springs of various strengths to achieve virtually any desired differential pressure setting.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A switch device for detecting when the pressure differential between high and low pressures exceeds a preselected level, said switch device comprising:

a housing having high and low pressure ports adapted to receive the respective high and low pressures, said housing presenting a piston chamber therein between said ports;

a piston in said piston chamber having opposed faces exposed to the respective high and low pressure ports to urge the piston toward the low pressure port under the influence of the pressure differential between the high and low pressures;

a shaft supported for rotation in said housing, said shaft having a lever arm and a switch arm extending outwardly from the shaft at spaced apart locations;

means coupling said piston with said lever arm in a manner to move an outer portion of the lever arm in a direction to turn said shaft in a first rotative direction upon movement of said piston toward the low pressure port;

resilient means exerting a biasing force on said shaft urging said shaft in a second rotative direction opposite said first direction, said resilient means resisting movement of said piston toward the low pressure port when said pressure differential is below said preselected level but yielding to permit rotation of the shaft in said first direction when said pressure differential exceeds said preselected level;

a pair of seal elements sealing said shaft to said housing at locations on opposite sides of said lever arm to isolate said switch arm and resilient means from the fluid in said ports; and switch means actuated by said switch arm upon movement of said shaft in said first rotative direction, said switch means thereby being actuated when the pressure differential exceeds said preselected level.

2. A switch device as set forth in claim 1, including a pair of bearings mounted to the housing and providing rotative support for said shaft at locations on opposite sides of said lever arm, said seal elements being located between said lever arm and each bearing to isolate the bearings from the fluid in said ports.

3. A switch device as set forth in claim 1 including means for venting said housing at locations outwardly of said seal elements.

4. A switch device as set forth in claim 1 including means accessible exteriorly of said housing for adjusting the biasing force exerted on said shaft by said resilient means, thereby adjusting said preselected pressure differential.

5. A switch device as set forth in claim 1, wherein said resilient means includes a lever extending outwardly from said shaft and a spring applying a force to said lever at a location outwardly of the shaft, thereby urging said shaft in said second rotative direction.

6. A switch device as set forth in claim 5, including:

a first spring retainer mounted on said lever;

a second spring retainer spaced from the first retainer with said spring extending between said first and second spring retainers; and means for effecting movement of said second retainer toward and away from said first retainer to thereby adjust the force applied to said lever by the spring.

7. A switch device as set forth in claim 1, wherein said coupling means includes a plunger carried on said piston and projecting therefrom toward the low pressure port, said plunger contacting said lever arm at a location outwardly of said shaft.

8. A switch device as set forth in claim 7, wherein said switch arm engages said switch means at a location more distant from said shaft than the point of contact between said plunger and lever arm.

9. A switch device sensitive to a pressure differential between high and low pressures, said switch device comprising:

a housing having high and low pressure ports for receiving the respective high and low pressures and a piston chamber between the ports, said housing defining therein a low pressure chamber between the low pressure port and the piston chamber;

a piston mounted in said piston chamber in sealed relation thereto and having opposed pressure faces exposed to the high pressure port and the low pressure chamber, whereby the pressure differential between the high and low pressures urges the piston toward the low pressure chamber to a limiting position;

a plunger carried on said piston and projecting therefrom into said low pressure chamber;

a shaft supported for rotation in said housing and having a switch arm and a spring arm extending outwardly from the shaft near opposite end portions thereof;

a lever arm extending outwardly from said shaft intermediate said opposite end portions thereof, said lever arm being engaged by said plunger within the low pressure chamber in a manner to rotate said shaft to a predetermined rotative position upon movement of said piston to said limiting position;

a pair of seal elements sealing said shaft to said housing at locations between the lever arm and switch arm and between the lever arm and spring arm;

a spring mounted in said housing and exerting a biasing force on said spring arm maintaining the shaft away from said predetermined rotative position when the pressure differential is below said preselected level, said spring yielding to permit movement of the shaft to said predetermined position when the pressure differential exceeds said preselected level;

means for adjusting the force exerted on said spring arm by said spring to thereby vary said preselected level; and switch means actuated by said switch arm when said shaft is in said predetermined rotative position, whereby said switch means is actuated when the pressure differential exceeds said preselected level.

10. A switch device as set forth in claim 9, including a pair of bearings mounted in said housing between said opposite end portions of the shaft to rotatively support the shaft, said seal elements being located between said lever arm and each bearing.

11. A switch device for detecting when the pressure differential between high and low pressures exceeds a preselected level, said switch device comprising:

a housing having high and low pressure ports adapted to receive the respective high and low pressures, said housing presenting a piston chamber therein between said ports;

a piston in said piston chamber having opposed faces exposed to the respective high and low pressure ports to urge the piston toward the low pressure port under the influence of the pressure differential between the high and low pressures;

an axially elongated cylindrical shaft supported for rotation in said housing, said shaft having a lever arm and a switch arm at an axially intermediate portion of the shaft extending outwardly from the shaft at an axial end portion thereof;

means coupling said piston with said lever arm in a manner to move an outer portion of the lever arm in a direction to turn said shaft in a first rotative direction upon movement of said piston toward the low pressure port;

resilient means exerting a biasing force on an opposite axial end portion of said shaft urging said shaft in a second rotative direction opposite said first direction, said resilient means resisting movement of said piston toward the low pressure port when said pressure differential is below said preselected level but yielding to permit rotation of the shaft in said first direction when said pressure differential exceeds said preselected level; and switch means actuated by said switch arm upon movement of said shaft in said first rotative direction, said switch means thereby being actuated when the pressure differential exceeds said preselected level.

12. A switch device for detecting when the pressure differential between high and low pressures exceeds a preselected level, said switch device comprising:

a housing having high and low pressure ports adapted to receive the respective high and low pressures, said housing presenting a piston chamber therein between said ports;

a piston in said piston chamber having opposed faces exposed to the respective high and low pressure ports to urge the piston toward the low pressure port under the influence of the pressure differential between the high and low pressures;

an axially elongated cylindrical shaft supported for rotation in said housing, said shaft having a lever arm and a switch arm extending outwardly from the shaft at axially spaced apart locations along the length of said shaft, said switch arm having a greater length than said lever arm;

means coupling said piston with said lever arm in a manner to move an outer portion of the lever arm in a direction to turn said shaft in a first rotative direction upon movement of said piston toward the low pressure port;

resilient means exerting a biasing force on said shaft urging said shaft in a second rotative direction opposite said first direction, said resilient means resisting movement of said piston toward the low pressure port when said pressure differential is below said preselected level but yielding to permit rotation of the shaft in said first direction when said pressure differential exceeds said preselected level; and switch means actuated by a preselected portion of said switch arm upon movement of said shaft in said first rotative direction, said preselected portion of said switch arm being more distant from the axis of said shaft then said outer portion of the lever arm, thereby amplifying the movement of said preselected portion of the switch arm in comparison to the movement of said outer portion of said lever arm.

* * * * *